United States Patent [19]

Leeds

[11] 4,166,572

[45] Sep. 4, 1979

[54] COMBINED TRASH RECEPTACLE FOR TABLE USE

[76] Inventor: Winthrop M. Leeds, 212 Overdale Rd., Pittsburgh, Pa. 15221

[21] Appl. No.: 822,537

[22] Filed: Aug. 8, 1977

[51] Int. Cl.[2] ..... A24F 19/08; B65F 1/00

[52] U.S. Cl. ..... 232/1 R; 232/43.1; 206/216

[58] Field of Search ..... 232/1 R, 43.1, 43.2; 206/216; D48/20 D, 2; D27/15; D11/144

[56] References Cited

U.S. PATENT DOCUMENTS

| | | | |
|---|---|---|---|
| D. 52,736 | 12/1918 | Graff | D27/15 |
| D. 138,046 | 6/1944 | Barry | D48/20 D |
| D. 154,352 | 6/1949 | Wetterhahn | D48/20 D |
| D. 175,103 | 7/1955 | Boyer | D11/144 |
| D. 190,134 | 4/1961 | Barber | D48/2 |
| D. 201,941 | 8/1965 | Feldman | D27/15 X |
| 367,316 | 7/1887 | Pardee | 232/1 R |
| 383,862 | 6/1888 | Clarke | D48/20 D |
| 1,143,416 | 6/1915 | Matthews | 232/1 R |
| 1,232,649 | 7/1917 | Boyd | 232/1 R |
| 1,713,890 | 5/1929 | Clark | 232/43.2 |
| 2,592,255 | 4/1952 | Drees | 232/1 R |
| 2,633,398 | 3/1953 | McAllister | 232/1 R |
| 3,566,882 | 3/1971 | Schroeder | 232/43.2 |
| 3,944,110 | 3/1976 | Willis | D27/15 X |

FOREIGN PATENT DOCUMENTS

| | | | |
|---|---|---|---|
| 1203943 | 8/1959 | France | 232/43.1 |

*Primary Examiner*—Francis K. Zugel
*Attorney, Agent, or Firm*—W. R. Crout

[57] ABSTRACT

A combined trash receptacle is proposed to be used on dining tables in public restaurants, or at home for the ready disposal of paper and plastic items provided for sanitary reasons, which would otherwise tend to clutter the table top in an unsightly manner. The trash receptacle is provided with one or more openings on the side thereof for the insertion and disposal of trash, and is moreover combined with either an accompanying ashtray, lamp stand, candle holder or flower vase, which in each case preferably serves additionally as the lid or cover for the trash receptacle.

3 Claims, 5 Drawing Figures

FIG. 1
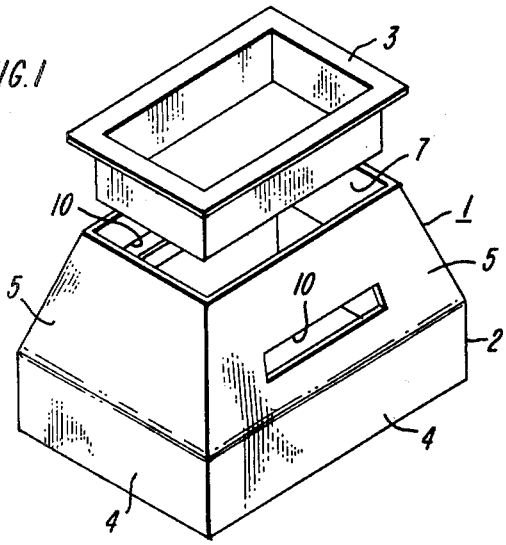
FIG. 2
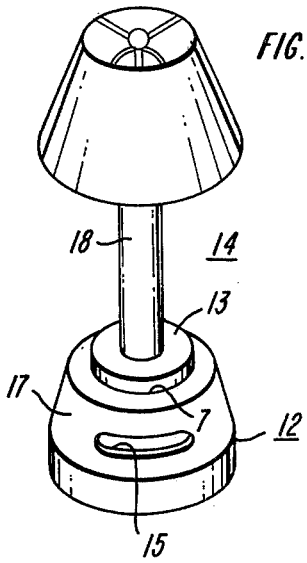
FIG. 3
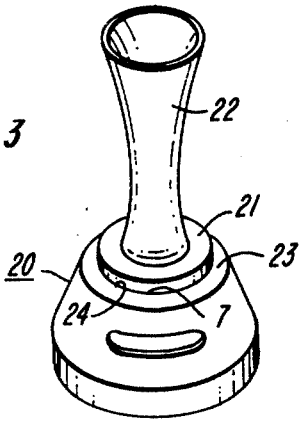
FIG. 4
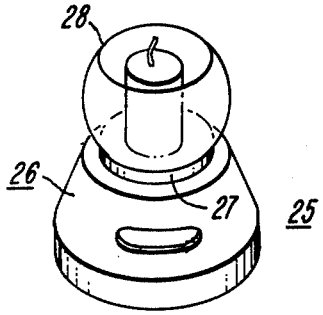
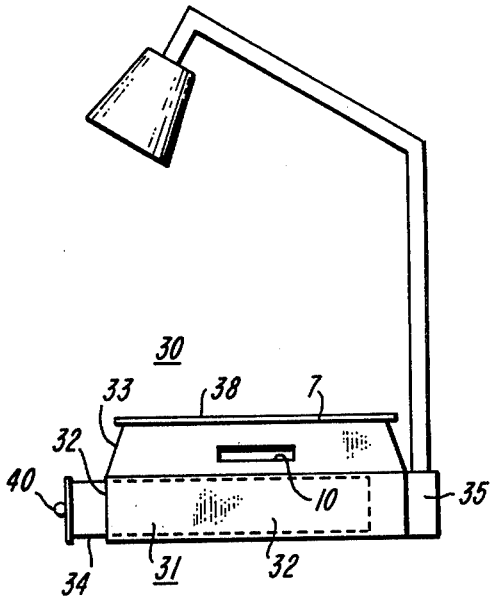
FIG. 5

COMBINED TRASH RECEPTACLE FOR TABLE USE

BACKGROUND OF THE INVENTION

An attractive public restaurant is characterized by an appearance of neatness and cleanliness. This is difficult to maintain when dining tables quickly become cluttered with various paper and plastic items provided largely in conformance with sanitary regulations. Such items consist of paper envelopes for sugar, waxed paper covers for wafers, paper covers for drinking straws, waxed paper covers for butter pats, plastic jelly containers, tooth picks used with hors d'oeuvres,—not to mention trash associated with smoking, such as plastic cigar covers and paper cigar bands, empty match covers and tops of cigarette packages.

This invention provides a convenient trash receptacle in which diners can dispose of these pieces of paper and plastic as they appear so as to keep them out of sight, at the same time avoiding the possibility of creating a small blaze resulting from trash being carelessly dropped in an ashtray containing an unextinguished cigarette.

Since dining tables either at home, or in public restaurants are often crowded for space, a trash receptacle could take up room in an objectionable manner, so an important feature of this invention is a space-saving arrangement whereby the lid or cover for the receptacle serves as any one of several possible useful functions, such as an ashtray, candle holder, flower vase or table lamp. One embodiment of the invention combines three functions—trash receptacle, ashtray and table lamp—all in one space-saving device.

One prior means of performing table trash disposal has been used in a self-service "fast food" restaurant by providing a large slot in the top of the table, giving access to a container beneath the table. It is obvious that this solution is hardly suitable for an attractive restaurant with cloth-covered tables for which the subject invention is particularly designed in a number of novel embodiments.

SUMMARY OF THE INVENTION

It is the object of this invention to provide a table trash receptacle for use in dining rooms, either at home or in a public restaurant, the receptacle being suitable for the disposal of paper and plastic items, such as covers or containers for sugar, drinking straws, wafers, butter, jelly, etc. A characteristic space-saving feature of the invention is the design of the cover or lid of the trash receptacle which performs at least one added useful function, such as serving as an ashtray, candle holder, flower vase or table lamp.

BRIEF DESCRIPTION OF THE DRAWING

FIG. 1 illustrates a trash receptacle for dining table use in which the cover of the receptacle also serves as an ashtray;

FIG. 2 illustrates a trash receptacle for dining table use in which the cover of the receptacle is combined with a table lamp support;

FIG. 3 illustrates a trash receptacle for dining table use in which the cover of the receptacle is combined with the base of a flower vase;

FIG. 4 illustrates a trash receptacle for dining table use in which the cover of the receptacle also serves as a candle holder; and, FIG. 5 illustrates a trash receptacle for dining table use which is combined with a table lamp, the receptacle having a cover which also serves as an ashtray.

DESCRIPTION OF THE PREFERRED EMBODIMENTS

With particular attention being directed to FIG. 1 of the drawings, it will be observed that there is provided one embodiment of the table trash receptacle 1 which combines, generally, a trash receptacle 2 with an upper-disposed ashtray lid member 3. Preferably, the lower portion 2 may be, for example, a square box having dimensions, for example, 6 inches on a side. The four sides 4 are vertical, as shown, for approximately 1 to 2 inches, for example, and then taper inwardly for about 1½ to 2 inches, as at 5, in the general form of a truncated pyramid with about, for example, a 4-inch square opening 7 provided on the top, as shown. The trash receptacle box 1 may be made out of a variety of materials, such as cardboard, plastic, wood or metal, as desired.

As illustrated in FIG. 1, an upper-disposed square ashtray 3 is provided, being preferably made of glass, porcelain, metal or some other suitable heat-resistant material, being fitted into the upper open end 7 of the trash receptacle 1, forming therewith a lid or cover member 3, which is easily removable for the purpose of emptying and cleaning the receptacle. Slots 10, which may be rectangular, oval or other suitable configuration, as desired, may be provided having, for example, a ¾" top-to-bottom slot, and being, for example, 3 to 4 inches long, as shown in FIG. 1. Preferably, two such slots 10 may be provided on the opposite sloping sides 5 of the receptacle 1, as shown, so that trash paper and plastic trash may readily be slipped into the open slots 10 of the trash receptacle 1. If desired, a pair of spring-retrieved hinged covers 9 (not shown) may be added internally of the receptacle 1 as an added optional refinement, thereby covering collected trash from the view of the diners.

In some restaurants, a small electrical lampstand is often provided for each dining table to enhance the dining atmosphere. FIG. 2 shows a modification 14 of my invention in which the trash receptacle 12 is made in a circular form, as shown, preferably of metal to match the lamp base 13. The tapered part of the receptacle is a truncated cone with a recessed ledge 14 to support the lamp base 13 when fitted into the top opening of the trash receptacle 12. Two generally oval-shaped openings, or slots 15 may be provided in the tapered portion 17 of the trash receptacle for the ready insertion of trash items. It will be evident that the lamp 18, acting as a cover or lid, can be lifted up and set to one side when it is desired to empty the trash receptacle 12.

Another embodiment 20 of my invention is illustrated in FIG. 3 of the drawings in which in this embodiment the upper lid or cover 21 is formed by the base of a flower vase 22, which would normally be made of glass, but could be, alternatively, made of porcelain, plastic or metal. Here again, the base 21 of the vase 22 fits on a ledge 23 down into the upper top opening 24 of the trash receptacle 20, thereby acting as a removable cover or lid.

FIG. 4 shows still another embodiment 25 of my invention in which the circular trash receptacle 26 is provided with a bowl-shaped glass candle-holder 28, which sits in the upper top opening to act as a lid or cover for the trash receptacle 26. In this case, an interior supporting ledge is not necessary, although a small circular ridge 27 on the glass bowl, as shown, adds desirable stability to the candle-holder assembly 28.

A combination lampstand, trash receptacle and ashtray is illustrated in a further embodiment 30 of my invention, as illustrated more clearly in FIG. 5 of the drawings. The rectangular base 31 is proportioned a little differently than that shown in FIG. 1, since in this embodiment of the invention the vertical sides 32 may be, for example, 3 inches high and the inwardly tapered upper portion 33 may be, for example, only about 1½ inches high. One vertical side of the base 32 is left open so that a removable box-type drawer 34 may be slipped into the base receptacle 31. The lamp support 35, however, is preferably permanently attached to the back side of the receptacle base 31, directly opposite, as shown, to the open side, into which the removable drawer 34 is inserted. As was the case in the embodiment of my invention illustrated in FIG. 1, the top opening 7 of the truncated pyramidal receptacle 31 is filled with a removable ashtray 38 acting as a removable top cover member. The ashtray 38 is easily lifted off at any time for the disposal, or emptying of the cigarette ashes. Trash, however, is removed by pulling out the removable drawer 34 and inverting it to dump out the trash contents thereof. A knob 40 may be provided on the front of the removable receptacle drawer 34 to allow it to be pulled out easily. As was the case with the other trash-receptacle modifications illustrated, a pair of oppositely disposed oval openings, or slots 10 are provided in the upper sloping sides 33 of the receptacle base 31 for the ready insertion of trash items.

From the foregoing, it will be observed that there is provided an improved combined trash-receptacle assembly for the use of the restaurant trade, or, where desired, for even actual home use. The assembly offers a means for the ready disposal of trash items, yet provides, with no additional table space, a means for supporting an accompanying lamp, flower vase, candle holder, or supporting base for a lamp in an attractive space-saving arrangement. As with the embodiment illustrated in FIG. 5, the device may be readily suitable for use in a home having a desk, in a den, or other study location. It will be obvious, moreover, that the support, provided in FIG. 5 for a lamp, may, additionally, be used for the accommodation of a radio, clock, or other item, which adds convenience to its use in such a study.

Although there have been illustrated and described specific embodiments of the invention, it is to be clearly understood that the same were merely for the purpose of illustration, and that changes and modifications may readily be made therein by those skilled in the art, without departing from the spirit and scope of the invention.

Having thus described the invention and illustrated its use, what is claimed as new and is desired to be secured by Letters Patent is:

1. A combined relatively-small portable trash receptacle container (30) for dining-table use comprising, in combination:

(a) means defining a lower-disposed box-shaped rectangular trash-receptacle container having inwardly-sloping side walls adaptable for placing upon a dining-table top and having a hollow interior with an upper-disposed supporting opening (7);

(b) one or more slot openings (10) disposed in said inwardly-sloping side walls of said rectangularly shaped trash-receptacle container (30) for the accommodation of trash items;

(c) a removable open-topped trash-receptacle sliding drawer (34) of rectangular configuration slidable into the lower base portion of said rectangularly shaped trash-receptacle container (30) and removable therefrom;

(d) an upper-disposed substantially cup-shaped cigarette ashtray removable from the upper supporting opening (7) of the trash-receptacle container (30) and serving as the removable lid for the trash receptacle container (30); and, (e) a permanently attached lamp fixture secured to the rear portion of the aforesaid trash receptacle container (30) and affixed thereto on the side of said rectangularly shaped trash receptacle container opposite from said removable open-topped drawer of rectangular configuration (34) for illuminating purposes.

2. The combination according to claim 1, wherein said lamp fixture is of the goose-neck variety for illuminating the table area in front of the trash receptacle container.

3. The combination according to claim 2, wherein the upper-disposed supporting opening (7) is of rectangular configuration, and the cup-shaped cigarette ashtray is also of rectangular configuration with the periphery thereof overlying the said rectangular supporting opening (7).

* * * * *